US010615542B2

(12) United States Patent
Holub et al.

(10) Patent No.: US 10,615,542 B2
(45) Date of Patent: Apr. 7, 2020

(54) CONNECTOR POSITION ASSURANCE LOCKING MECHANISM AND METHOD OF OPERATING THE CONNECTOR POSITION ASSURANCE LOCKING MECHANISM

(71) Applicant: J.S.T. CORPORATION, Farmington Hills, MI (US)

(72) Inventors: Franklin A. Holub, West Bloomfield, MI (US); Vikas Azad, Novi, MI (US); Darrell George, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 192 days.

(21) Appl. No.: 15/243,008

(22) Filed: Aug. 22, 2016

(65) Prior Publication Data

US 2017/0062982 A1 Mar. 2, 2017

Related U.S. Application Data

(60) Provisional application No. 62/213,314, filed on Sep. 2, 2015.

(51) Int. Cl.

| | |
|---|---|
| ***H01R 13/641*** | (2006.01) |
| ***H01R 13/639*** | (2006.01) |
| ***H01R 13/627*** | (2006.01) |

(52) U.S. Cl.

CPC ..... *H01R 13/639* (2013.01); *H01R 13/6271* (2013.01); *H01R 13/6272* (2013.01); *H01R 13/641* (2013.01)

(58) Field of Classification Search

CPC ..... H01R 13/641; H01R 13/6272

See application file for complete search history.

(56) References Cited

U.S. PATENT DOCUMENTS

| | | | | |
|---|---|---|---|---|
| 5,330,369 | A * | 7/1994 | Nozaki | H01R 13/641 439/350 |
| 5,584,719 | A | 12/1996 | Tsuji et al. | |
| 5,628,649 | A | 5/1997 | Yagi et al. | |
| 5,759,058 | A | 6/1998 | Childs et al. | |
| 5,823,813 | A | 10/1998 | Dye | |
| 6,116,939 | A | 9/2000 | Fukuda | |
| 6,186,819 | B1 | 2/2001 | Holub | |

(Continued)

FOREIGN PATENT DOCUMENTS

| | | |
|---|---|---|
| EP | 0862244 A1 | 9/1998 |
| EP | 1096616 A2 | 5/2001 |

(Continued)

OTHER PUBLICATIONS

European Search Report in European Application No. 17191762.8, dated Dec. 12, 2017.

(Continued)

*Primary Examiner* — Tho D Ta

(74) *Attorney, Agent, or Firm* — Kratz, Quintos & Hanson, LLP

(57) ABSTRACT

Connector apparatus having a male connector assembly, a female connector assembly, and a connector position assurance (CPA) device. The connector position assurance (CPA) device is inserted into one of the connector assemblies to lock the male connector assembly and female connector assembly together as an additional locking assurance.

20 Claims, 9 Drawing Sheets

(56) References Cited

U.S. PATENT DOCUMENTS

| | | | | |
|---|---|---|---|---|
| 6,312,277 | B1 * | 11/2001 | Holub | H01R 13/6272 439/352 |
| 6,435,895 | B1 * | 8/2002 | Fink | H01R 13/6272 439/352 |
| 7,909,638 | B2 | 3/2011 | Seo | |
| 8,070,498 | B2 * | 12/2011 | Shen | H01R 12/714 439/66 |
| 8,747,146 | B2 | 6/2014 | Brown et al. | |
| 8,920,187 | B2 | 12/2014 | Kon et al. | |
| 2002/0045380 | A1 | 4/2002 | Endo et al. | |
| 2003/0171027 | A1 * | 9/2003 | Shuey | H01R 13/6272 439/489 |
| 2004/0067676 | A1 | 4/2004 | Nimura | |
| 2004/0248453 | A1 | 12/2004 | McLauchlan et al. | |
| 2006/0276085 | A1 * | 12/2006 | Ma | H01R 13/2442 439/862 |
| 2012/0282791 | A1 | 11/2012 | Brown et al. | |
| 2016/0164224 | A1 | 6/2016 | Sekino | |
| 2017/0062983 | A1 | 3/2017 | Holub et al. | |
| 2017/0179643 | A1 | 6/2017 | Holub | |
| 2017/0179646 | A1 | 6/2017 | Holub | |

FOREIGN PATENT DOCUMENTS

| | | | |
|---|---|---|---|
| EP | 1926183 | A2 | 5/2008 |
| EP | 3016213 | A1 | 5/2016 |
| JP | 2003-264039 | | 9/2003 |
| JP | 2004-103551 | | 4/2004 |
| JP | 2009-037835 | | 2/2009 |
| JP | 2017-152273 | | 8/2017 |
| JP | 2017152273 | A | 8/2017 |

OTHER PUBLICATIONS

European Search Report in counterpart European Application No. 17191751.1, dated Mar. 27, 2018.
USPTO Office Action in U.S. Appl. No. 15/384,755, dated Jul. 26, 2017.
USPTO Office Action in U.S. Appl. No. 15/384,755, dated Mar. 21, 2018.
USPTO Office Action in U.S. Appl. No. 15/384,743, dated Feb. 16, 2018.
USPTO Office Action in U.S. Appl. No. 15/384,743, dated Jul. 27, 2017.
U.S. Appl. No. 15/854,295, filed Dec. 26, 2017.
USPTO Office Action in U.S. Appl. No. 15/243,023, dated Oct. 27, 2017.
USPTO Office Action in U.S. Appl. No. 15/243,023, dated Apr. 17, 2018.
European Search Report in European Application No. 17187151.0, dated Jan. 18, 2018.
European Search Report in European Application No. 17187152.8, dated Jan. 18, 2018.
U.S. Appl. No. 29/637,985, filed Feb. 23, 2018.
U.S. Appl. No. 29/637,988, filed Feb. 23, 2018.
U.S. Appl. No. 15/854,287, filed Dec. 26, 2017.
Japanese Office Communication in Japanese Application No. 2017-157487, dated Jul. 20, 2018.
Japanese Office Communication in Japanese Application No. 2017-157488, dated Jul. 20, 2018.
Annex to Office Action pursuant to Article 94(3) EPC of European Patent Application No. 17187151.0 dated Oct. 8, 2018 (6 pages).
Office Action of Japanese Patent Application No. 2017-157487: Notification of Reasons for Refusal dated Nov. 6, 2018 (3 pages, 3 pages translation, 6 pages total).
Annex to Office Action pursuant to Article 94(3) EPC of European Patent Application No. 17187152.8 dated Oct. 15, 2018 (8 pages).

* cited by examiner

CONNECTOR POSITION ASSURANCE LOCKING MECHANISM AND METHOD OF OPERATING THE CONNECTOR POSITION ASSURANCE LOCKING MECHANISM

CROSS-REFERENCE TO RELATED APPLICATIONS

This patent application claims priority to U.S. Provisional Patent Application No. 62/213,314, filed Sep. 2, 2015, which is hereby incorporated herein by reference in its entirety.

BACKGROUND OF THE INVENTION

The present invention generally relates to a connector position assurance (CPA) locking mechanism used to securely hold together a connector apparatus which has a male connector assembly and a female connector assembly. The connector position assurance (CPA) locking mechanism is inserted into one of the connector assemblies to lock the male connector assembly and female connector assembly together as an additional locking assurance.

BRIEF SUMMARY OF THE INVENTION

To ensure that the connector position assurance (CPA) locking mechanism is available to connect to the female connector assembly, the CPA locking mechanism can be engaged, in a pre-lock position, to the female connector assembly prior to transport of the female connector assembly.

The male connector assembly and female connector assembly are engaged together, and the engagement thereof is assured when the CPA locking mechanism is placed at a full-lock position. The CPA locking mechanism can also be referred to as a CPA device.

Additional features, advantages, and embodiments of the invention are set forth or are apparent from consideration of the following detailed description, drawings and claims. Moreover, it is to be understood that both the foregoing summary of the invention and the following detailed description are exemplary and are intended to provide further explanation without limiting the scope of the invention as claimed.

DETAILED DESCRIPTION OF THE PREFERRED EMBODIMENTS

Figure 1:
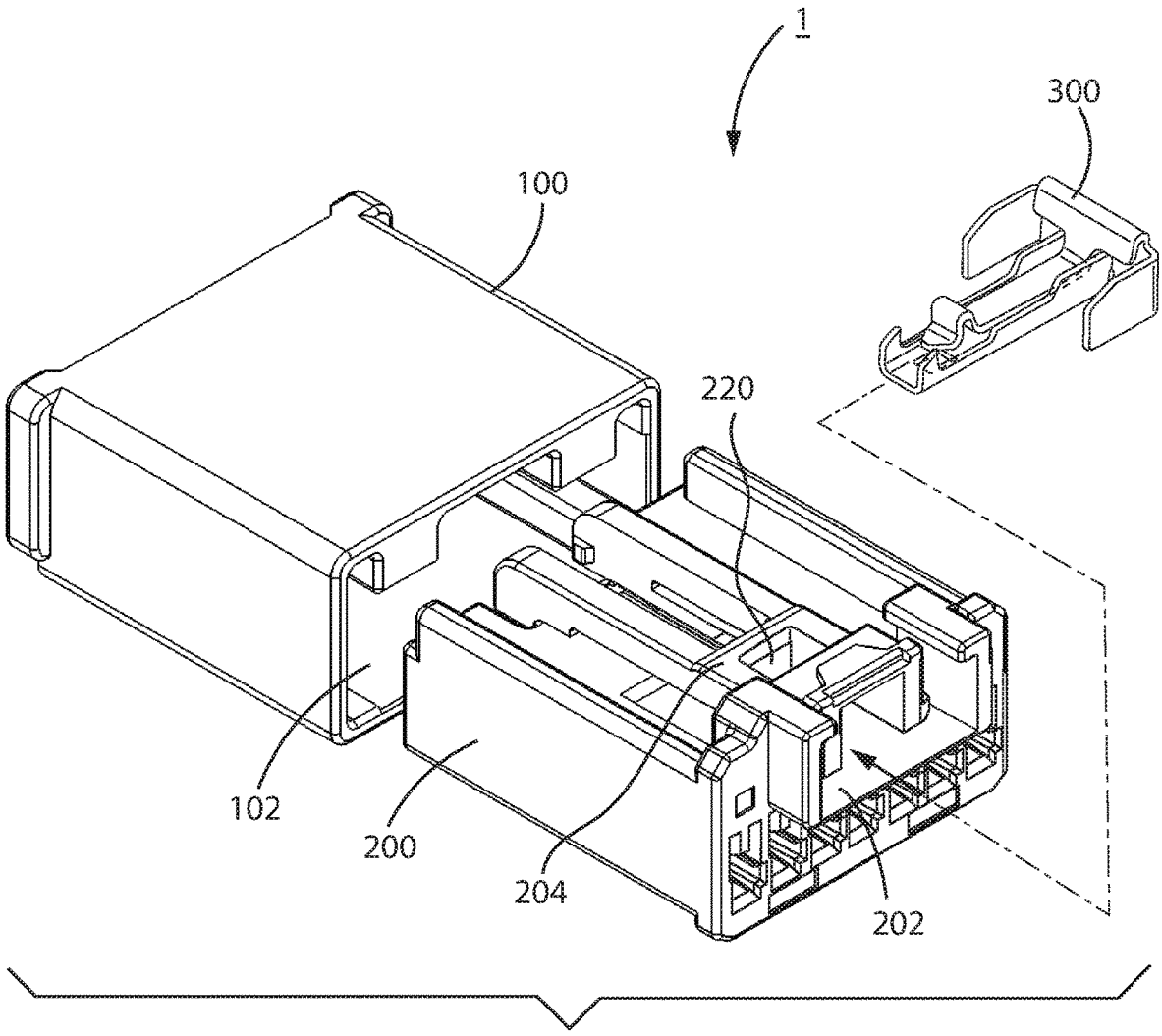
FIG. 1 is an exploded perspective view of the connector apparatus of the present invention having a male connector assembly, a female connector assembly, and a connector position assurance (CPA) device.

FIG. 1 is an exploded perspective view of the connector apparatus of the present invention having a male connector assembly, a female connector assembly, and a connector position assurance (CPA) locking mechanism. The connector position assurance (CPA) locking mechanism can also be referred to as a CPA device.

FIG. 1 illustrates, in an exploded perspective view, the connector apparatus, generally referred to by reference number 1, which includes male connector assembly 100, female connector assembly 200, and CPA device 300.

The male connector assembly 100 has an opening 102 for accommodating the female connector assembly 200. The opening 102 can be referred to as the male connector opening 102. The female connector assembly 200 has an opening 202 for accommodating the CPA device 300. The opening 202 can be referred to as the female connector opening 202. The female connector assembly 200 includes a locking component 204. An aperture 220 is formed by the locking component 204, as shown in FIG. 1.

Figure 2:
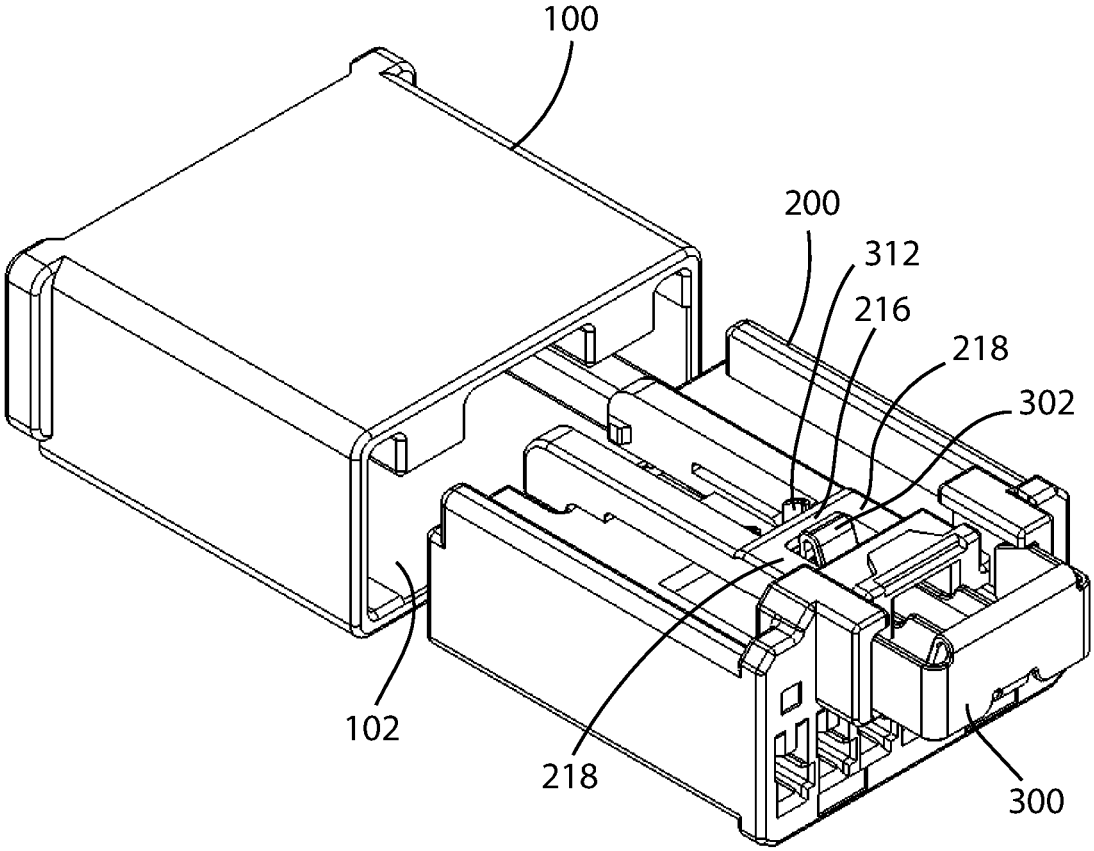
FIG. 2 is a top perspective view of the male connector assembly, the female connector assembly, and the CPA device, when the CPA device has been connected to the female connector assembly and the CPA device is in the pre-lock position.

FIG. 2 is a top perspective view of the male connector assembly 100, the female connector assembly 200, and the CPA device 300, when the CPA device 300 has been connected to the female connector assembly 200 and the CPA device 300 is in the pre-lock position. In FIG. 2, a tooth of the CPA device 300 is referred to by reference numeral 312, and a first curved upper region of the CPA device 300 is referred to by reference numeral 302.

On the female connector assembly 200, the locking component 204 includes at least a front portion 216 and two side portions 218, as shown in FIG. 2. In FIG. 2, the first curved upper region 302 of the CPA device 300 is shown to be penetrating the aperture 220 of the locking component 204.

Figure 3:
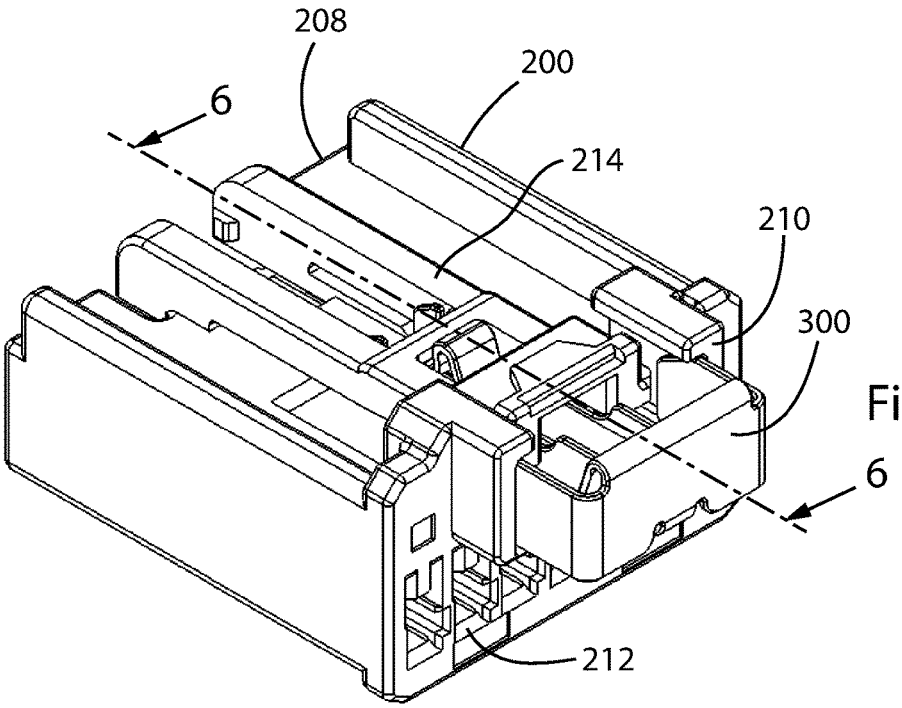
FIG. 3 is a top perspective view of the female connector assembly and the CPA device, when the CPA device has been connected to the female connector assembly and the CPA device is in the pre-lock position.

FIG. 3 is a top perspective view of the female connector assembly 200 and the CPA device 300, when the CPA device 300 has been connected to the female connector assembly 200 and the CPA device 300 is in the pre-lock position. The female connector assembly 200 has at least a first end 208 and a second end 210, at least one terminal aperture 212, and a top side 214. The female connector opening 202 is formed at the second end 210 of the female connector assembly 200. The first end 208 is to be inserted into the male connector opening 102 of the male connector assembly 100.

As shown in FIG. 3, the locking component 204 of the female connector assembly 200 is located at the top side 214.

Figure 4:
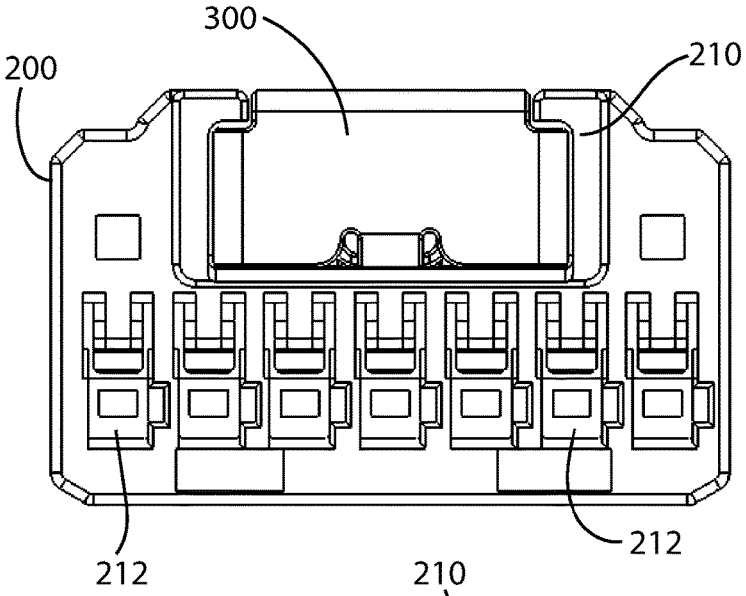
FIG. 4 is an end elevational view of the female connector assembly and the CPA device, when the CPA device has been connected to the female connector assembly and the CPA device is in the pre-lock position.
Figure 5:
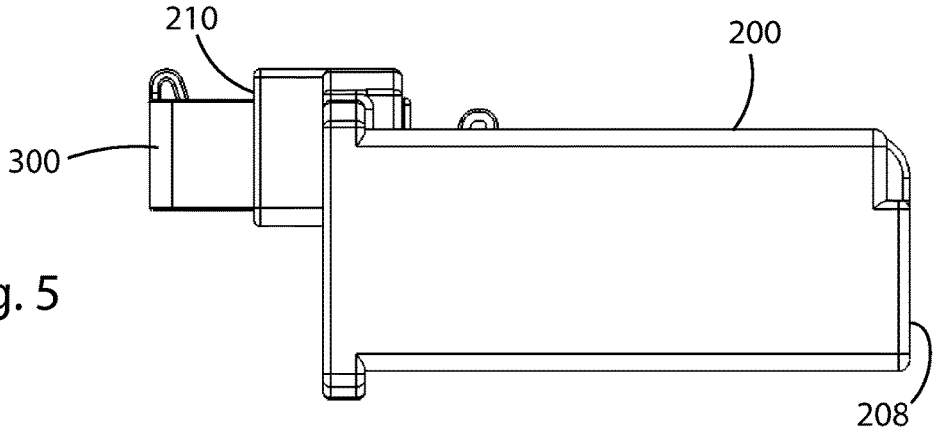
FIG. 5 is a side elevational view of the female connector assembly and the CPA device, when the CPA device has been connected to the female connector assembly and the CPA device is in the pre-lock position.

FIG. 4 is an end elevational view of the female connector assembly 200 and the CPA device 300, when the CPA device 300 has been connected to the female connector assembly 200 and the CPA device 300 is in the pre-lock position. FIG. 4 shows multiple terminal apertures 212 of the female connector assembly 200, for receiving terminals (not shown). FIG. 5 is a side elevational view of the female connector assembly 200 and the CPA device 300, when the CPA device 300 has been connected to the female connector assembly 200 and the CPA device 300 is in the pre-lock position.

Figure 6:
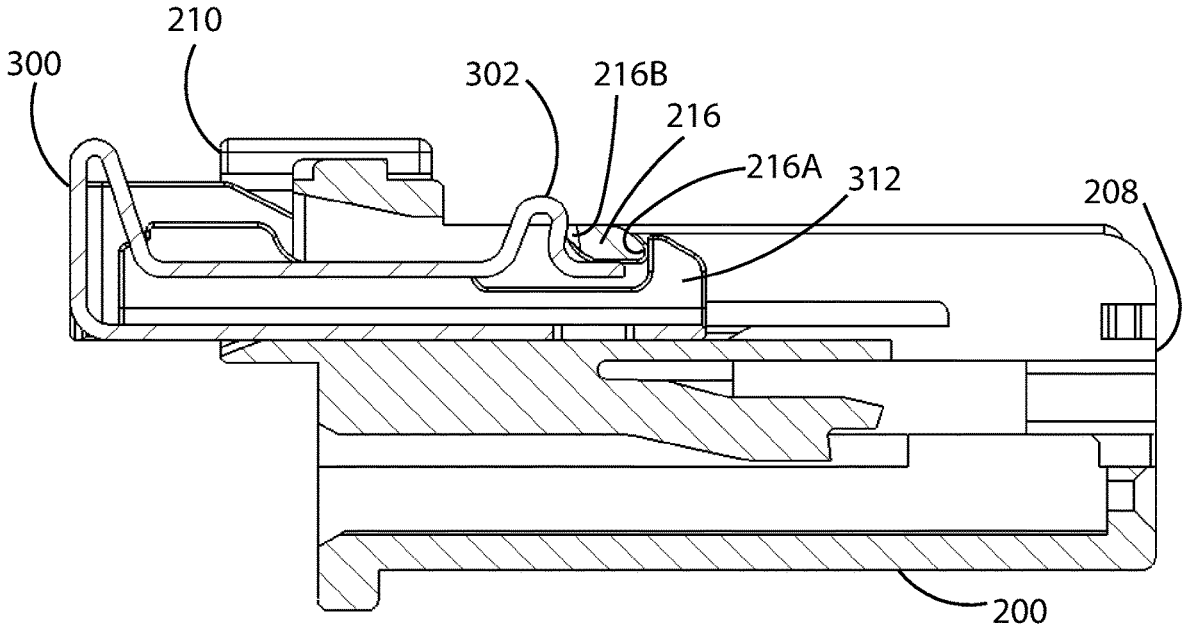
FIG. 6 is a cross-sectional view, taken along line 6-6 in FIG. 3, of the female connector assembly and the CPA device, when the CPA device has been connected to the female connector assembly and the CPA device is in the pre-lock position.

FIG. 6 is a cross-sectional view, taken along line 6-6 in FIG. 3, of the female connector assembly 200 and the CPA device 300, when the CPA device 300 has been connected to the female connector assembly 200 and the CPA device 300 is in the pre-lock position. As shown in FIG. 6, the female connector assembly 200 includes the locking component 204 having a front portion 216. The front portion 216 has a front edge denoted with reference numeral 216A and a rear edge denoted with reference numeral 216B, as shown in FIG. 6.

As shown in FIG. 6, the CPA device 300 has been partially inserted into the female connector opening 202 of the female connector assembly 200, and this can be referred to as the pre-lock position. FIG. 6 demonstrates that, for the pre-lock position, the teeth 312 have gone into the female connector assembly 200 to a position such that the teeth 312 have passed beyond the front portion 216. The teeth 312 are abutting and directly contacting the front edge 216A of the front portion 216, for the arrangement as shown in FIG. 6. Only one tooth 312 is shown in FIG. 6, because FIG. 6 is a cross-sectional view, but it can be understood that the CPA device 300 has two teeth 312 abutting and directly contacting the front edge 216A of the front portion 216, for the arrangement as shown in FIG. 6.

Also, FIG. 6 shows that, for the pre-lock position, the first curved upper region 302 has gone into the female connector assembly 200 to a position such that the first curved upper region 302 has not passed beyond the front portion 216. The first curved upper region 302 is abutting and directly contacting the rear edge 216B of the front portion 216, as shown in FIG. 6.

In the pre-lock position shown in FIG. 6, the teeth 312 have already passed under the front portion 216, but the first curved upper region 302 has not passed under the front portion 216.

The arrangement shown in FIG. 6, corresponding to the pre-lock position, can be utilized during transport of the female connector assembly and at other times.

Figure 7:
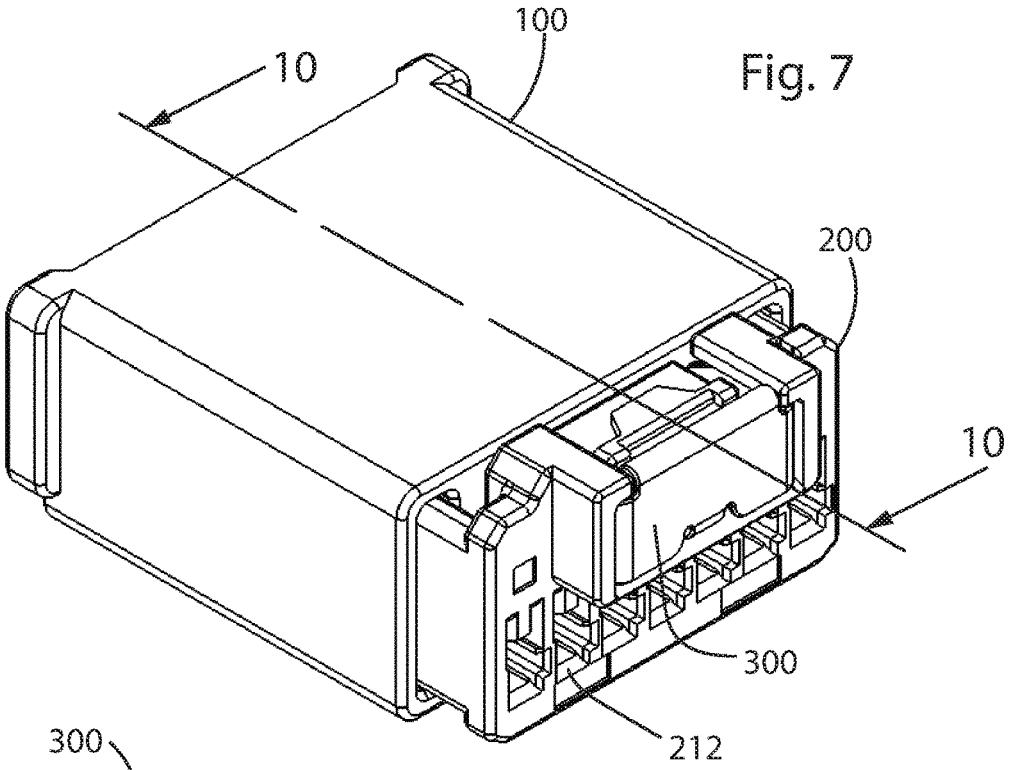
FIG. 7 is a top perspective view of the male connector assembly, the female connector assembly, and the CPA device, when the male connector assembly has been connected to the female connector assembly, the CPA device has been connected to the female connector assembly, and the CPA device is in the full-lock position.
Figure 8:
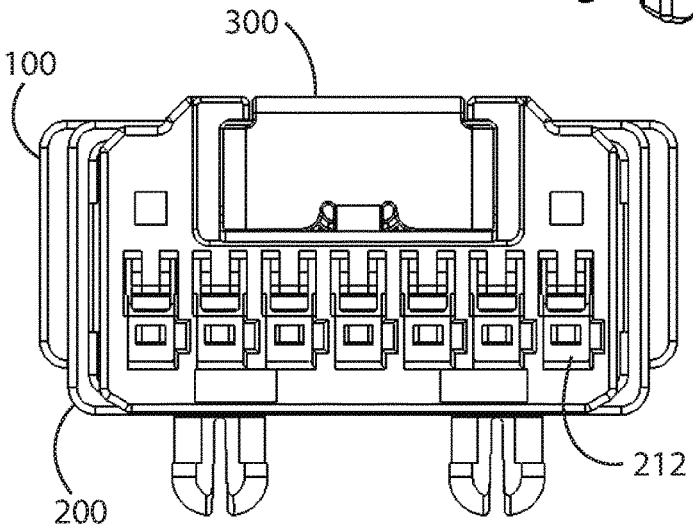
FIG. 8 is an end elevational view of the male connector assembly, the female connector assembly, and the CPA device, when the male connector assembly has been connected to the female connector assembly, the CPA device has been connected to the female connector assembly, and the CPA device is in the full-lock position.
Figure 9:
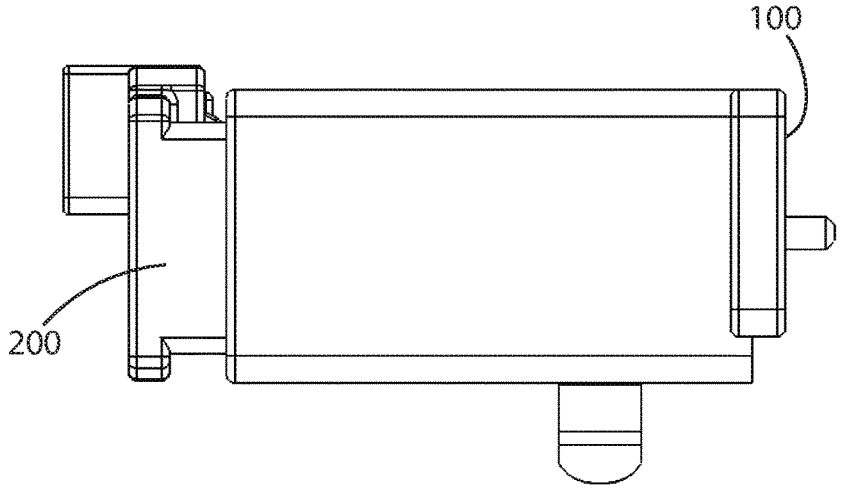
FIG. 9 is a side elevational view of the male connector assembly, the female connector assembly, and the CPA device, when the male connector assembly has been connected to the female connector assembly, the CPA device has been connected to the female connector assembly, and the CPA device is in the full-lock position.

FIG. 7 is a top perspective view of the male connector assembly 100, the female connector assembly 200, and the CPA device 300, when the male connector assembly 100 has been connected to the female connector assembly 200, the CPA device 300 has been connected to the female connector assembly 200, and the CPA device 300 is in the full-lock position. FIG. 8 is an end elevational view of the male connector assembly 100, the female connector assembly 200, and the CPA device 300, when the male connector assembly 100 has been connected to the female connector assembly 200, the CPA device 300 has been connected to the female connector assembly 200, and the CPA device 300 is in the full-lock position. FIG. 9 is a side elevational view of the male connector assembly 100, the female connector assembly 200, and the CPA device 300, when the male connector assembly 100 has been connected to the female connector assembly 200, the CPA device 300 has been connected to the female connector assembly 200, and the CPA device 300 is in the full-lock position.

Figure 10:
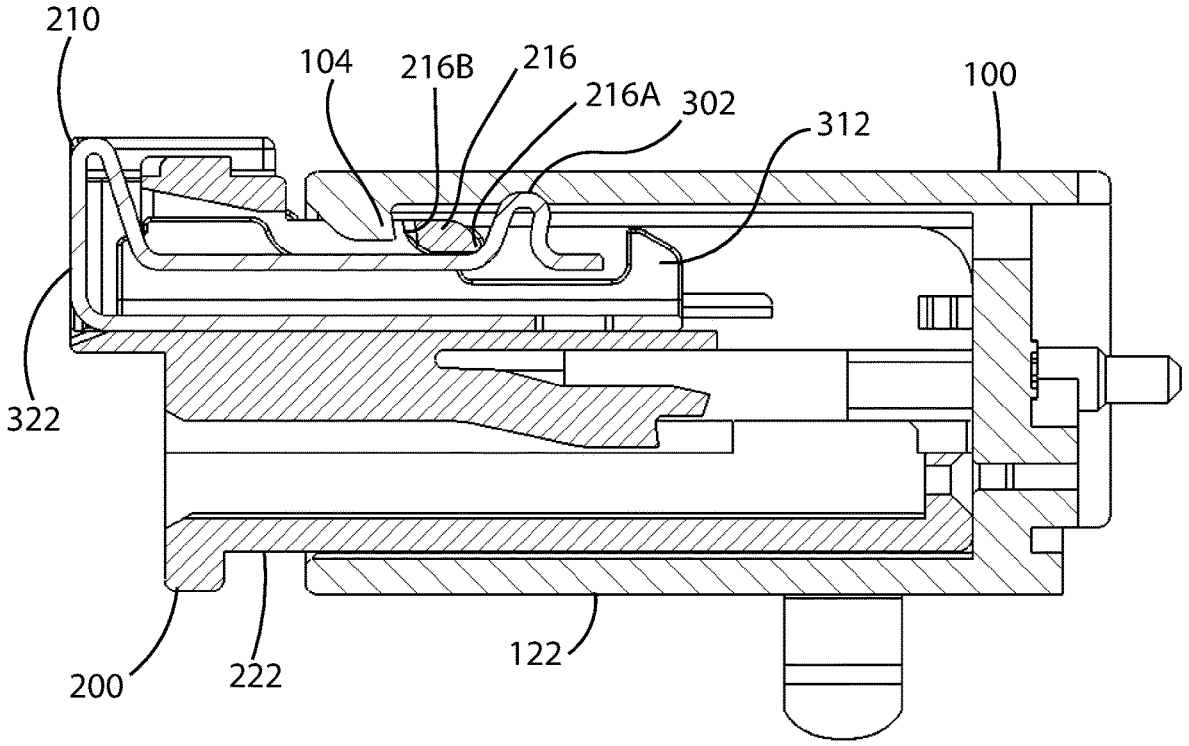
FIG. 10 is a cross-sectional view, taken along line 10-10 in FIG. 7, of the male connector assembly, the female connector assembly, and the CPA device, when the male connector assembly has been connected to the female connector assembly, the CPA device has been connected to the female connector assembly, and the CPA device is in the full-lock position.

FIG. 10 is a cross-sectional view, taken along line 10-10 in FIG. 7, of the male connector assembly 100, the female connector assembly 200, and the CPA device 300, when the male connector assembly 100 has been connected to the female connector assembly 200, the CPA device 300 has been connected to the female connector assembly 200, and the CPA device 300 is in the full-lock position.

As shown in FIG. 10, the female connector assembly 200 includes the locking component 204 having a front portion 216. Front edge 216A of the front portion 216 is shown in FIG. 10. Also, rear edge 216B of the front portion 216 is shown in FIG. 10.

FIG. 10 also shows that male connector assembly 100 has at least one latch 104. The male connector assembly 100 may also have additional latches. As shown in FIG. 10, the latch 104 will be at the rear edge 216B of the front portion 216 when the male connector assembly 100 is connected to the female connector assembly 200, the CPA device 300 is connected to the female connector assembly 200, and the CPA device 300 is in the full-lock position. As shown in FIG. 10, the latch 104 is located between the rear edge 216B and the second end 210 of the female connector assembly 200. Also, as shown in FIG. 10, the latch 104 is located between the rear edge 216B and the back 322 of the CPA device 300.

The latch 104 engages the locking component 204 in order to hold the male connector assembly 100 to the female connector assembly 200. In particular, the latch 104 engages the front portion 216 of the locking component 204 in order to hold the male connector assembly 100 to the female connector assembly 200. The male connector assembly 100 has a housing 122. The housing 122 forms the male connector opening 102. The latch 104 is on the interior of the housing 122, inside the male connector opening 102. The female connector assembly 200 has a housing 222. The housing 222 forms the female connector opening 202.

The teeth 312 engage the locking component 204 in order to hold the CPA device 300 to the female connector assembly 200 in the pre-lock position. In particular, the teeth 312 engage the front edge 216A of the front portion 216 of the locking component 204 in order to hold the CPA device 300 to the female connector assembly 200 in the pre-lock position.

The first curved upper region 302 engages the locking component 204 in order to hold the male connector assembly 100 to the female connector assembly 200 in the full-lock position. In particular, the first curved upper region 302 engages the front edge 216A of the front portion 216 of the locking component 204 in order to hold the male connector assembly 100 to the female connector assembly 200 in the full-lock position.

As shown in FIG. 10, the CPA device 300 has been fully inserted into the female connector opening 202 of the female connector assembly 200, and the female connector assembly 200 has been fully inserted into the male connector opening 102 of the male connector assembly 100. This can be referred to as the full-lock position. FIG. 10 demonstrates that the teeth 312 have gone into the female connector assembly 200 to a position such that the teeth 312 have passed beyond the front portion 216. FIG. 10 shows that first curved upper region 302 has gone into the female connector assembly 200 to a position such that the first curved upper region 302 has also passed beyond the front portion 216.

In the full-lock position as shown in FIG. 10, the first curved upper region 302 of the CPA device 300 is abutting and directly contacting the front edge 216A of the front portion 216. In the full-lock position shown in FIG. 10, the teeth 312 have passed under the front portion 216, and first curved upper region 302 has also passed under the front portion 216.

Figure 11:
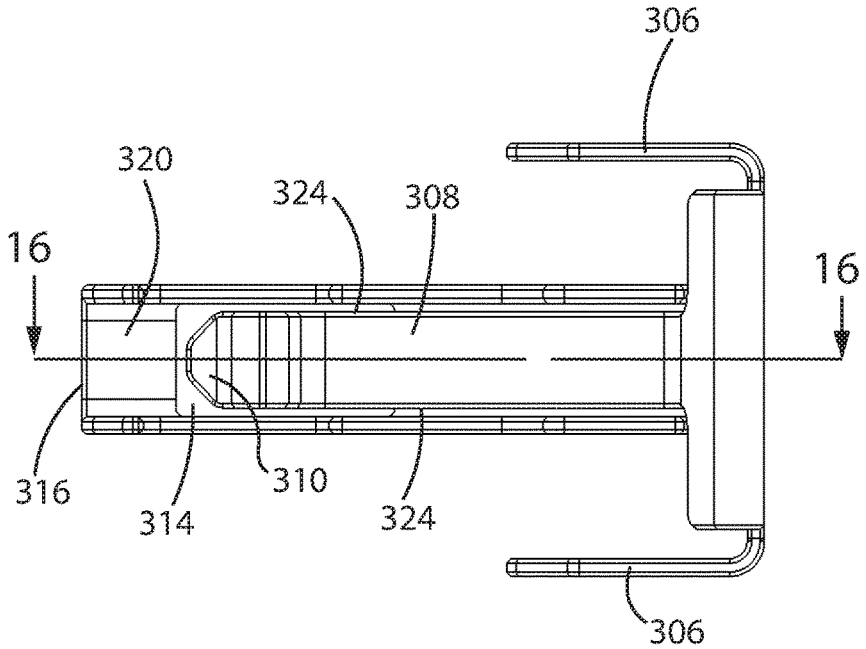
FIG. 11 is a top elevational view of the CPA device.
Figure 12:
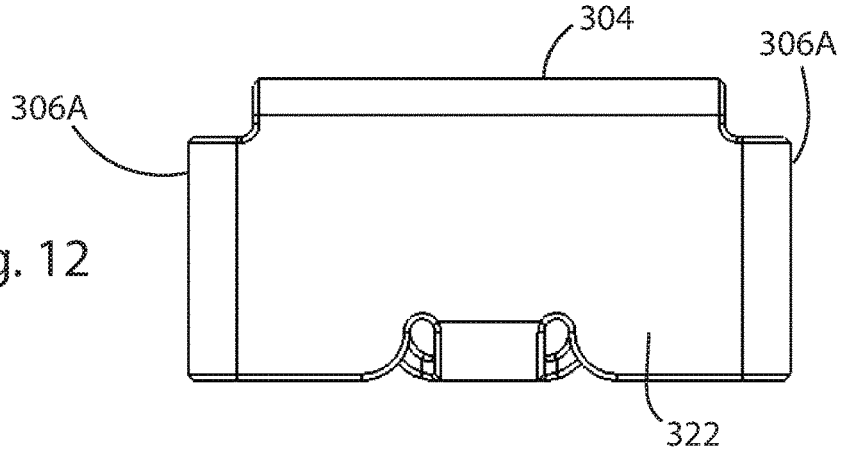
FIG. 12 is a rear end elevational view of the CPA device.
Figure 13:
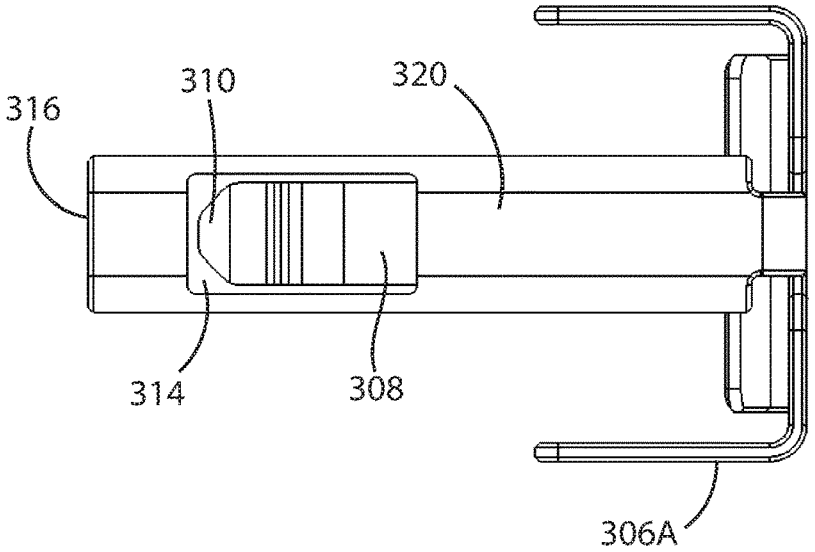
FIG. 13 is a bottom elevational view of the CPA device.
Figure 14:
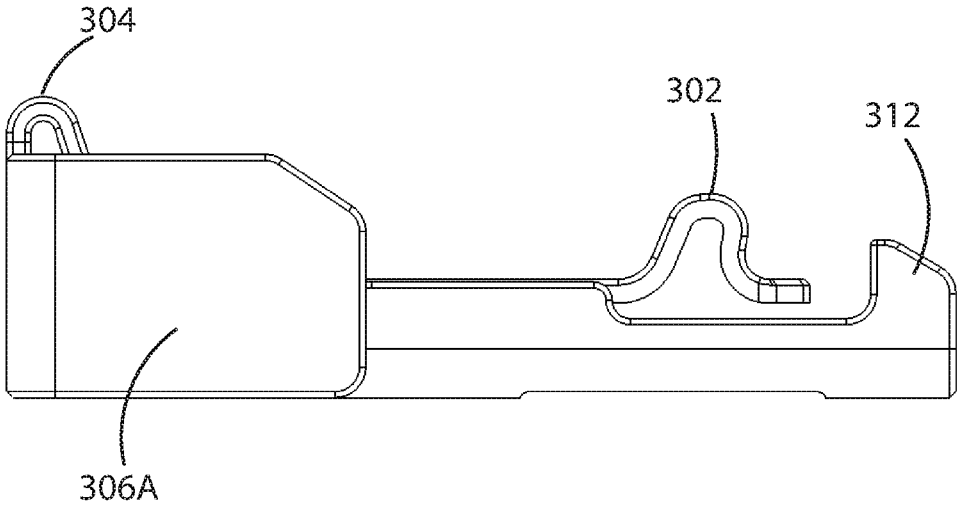
FIG. 14 is a side end elevational view of the CPA device.
Figure 15:
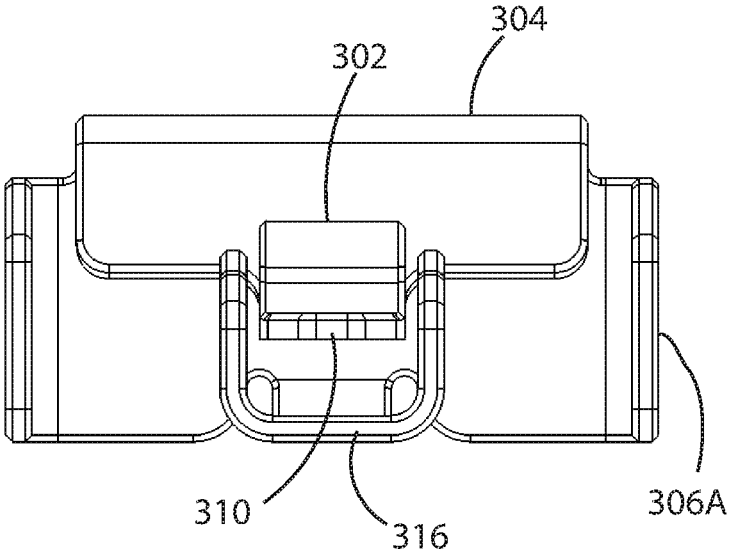
FIG. 15 is a front end elevational view of the CPA device.
Figure 16:
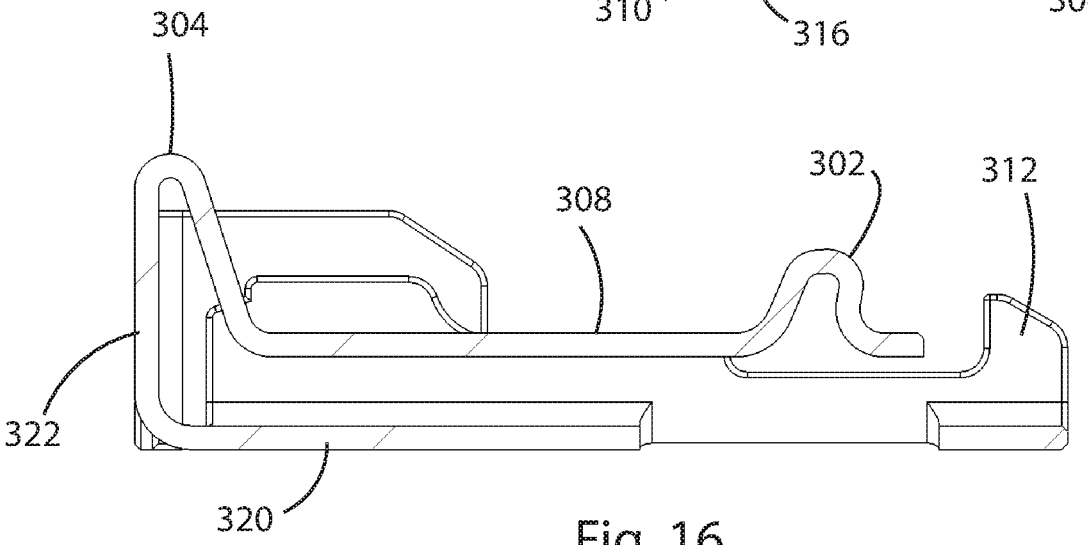
FIG. 16 is a cross-sectional view, taken along line 16-16 in FIG. 11, of the CPA device.
Figure 17:
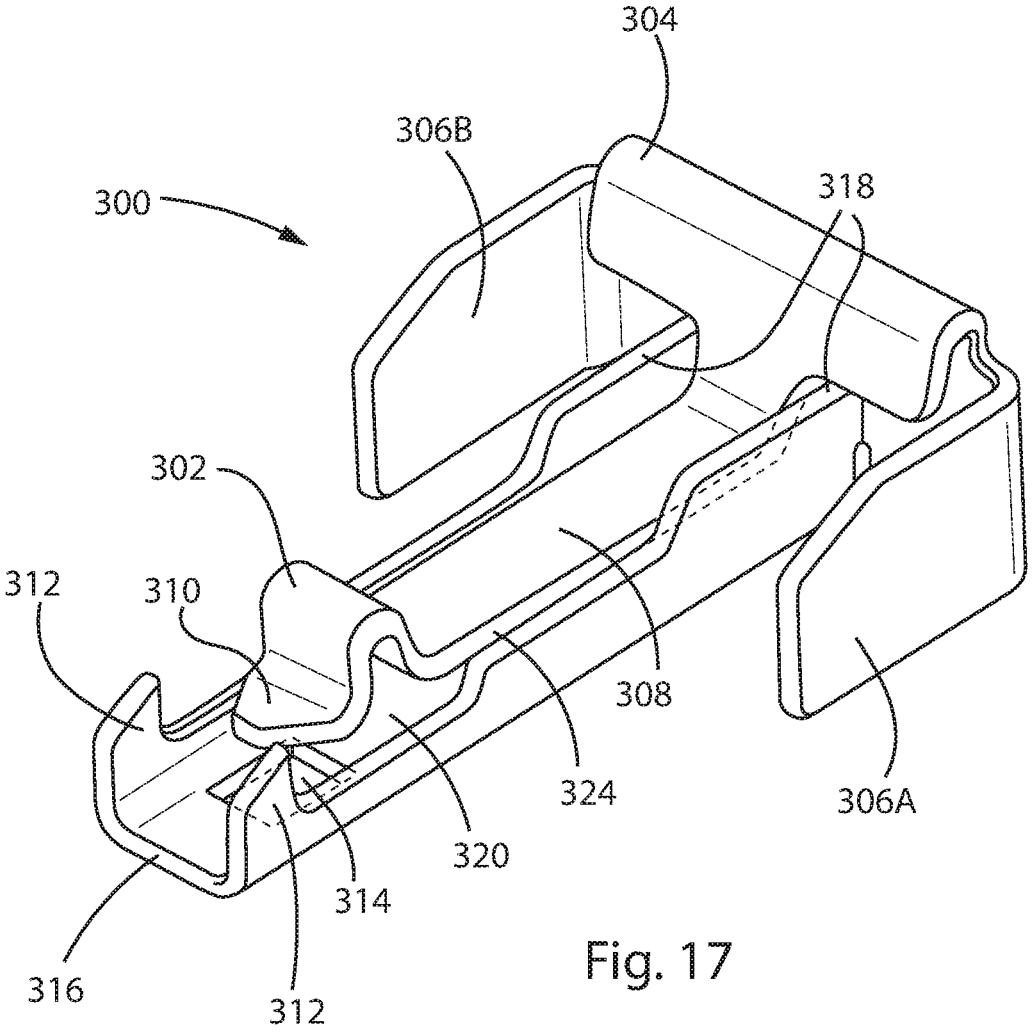
FIG. 17 is a perspective view of the CPA device.

FIG. 11 is a top elevational view of the CPA device 300. FIG. 12 is a rear end elevational view of the CPA device 300. FIG. 13 is a bottom elevational view of the CPA device 300. FIG. 14 is a side end elevational view of the CPA device 300. FIG. 15 is a front end elevational view of the CPA device 300. FIG. 16 is a cross-sectional view, taken along line 16-16 in FIG. 11, of the CPA device 300. FIG. 17 is a perspective view of the CPA device 300.

The CPA device 300 includes first curved upper region 302, second curved upper region 304, a pair of teeth 312, and other components as described herein. Although FIG. 17 shows an embodiment wherein the CPA device 300 has two teeth 312, it can be understood that, according to an alternative embodiment, the CPA device 300 can be modified to have only one tooth 312.

FIG. 11 shows that the CPA device 300 has a pair of arms 306. FIG. 17 shows an exterior surface 306A of one of the arms 306, and also shows an interior surface 306B of one of the arms 306. The exterior surfaces 306A of arms 306 have flat and smooth surfaces. The exterior surfaces 306A do not have protrusions extending outward away from the CPA device 300. Thus, the arms 306 can slide into the female connector opening 202 of the female connector assembly 200.

The CPA device 300 includes a two-component locking system having an upper component 308 and a lower component 320.

The upper component 308 can also be referred to as a flexible beam. The upper component 308 is able to flex downward toward the lower component 320, for example. The upper component 308 extends forward from the second curved upper region 304 toward the front 316 of the CPA device 300. The upper component 308 has a front end 310 and side edges 324.

The lower component 320 extends forward from the back 322 toward the front 316 of the CPA device 300. The lower component 320 forms an aperture 314. Edges of the lower component 320 are curved upward. The edges of the lower component 320 are referred to by reference numeral 318.

As shown in FIG. 11, for example, the side edges 324 are flat and smooth, and do not have protrusions extending outward toward edges 318 of the lower component 320. FIG. 17 also shows side edge 324 to be flat and smooth.

When the CPA device 300 is being moved from the pre-lock position to the full-lock position, the front portion 204 forces the first curved upper region 302 to move downward towards aperture 314 or into aperture 314.

The front end 310 of the upper component 308 has a surface that has rounded, smooth edges, as shown in FIG. 11, for example. The front end 310 of the upper component 308 is not split into multiple different sections.

The CPA device 300, with the above-described features and structural arrangements, allows the CPA device 300 to be in the pre-lock position and the full-lock position when inserted into the female connector opening 202 of the female connector assembly 200. The full-lock position of the CPA device 300 assures the full engagement, and subsequent locking, of the female connector assembly 200 to the male connector assembly 100.

A method for assembling the connector apparatus 1 shall now be described. With reference to FIG. 1, the CPA device 300 is inserted into the female connector opening 202 of the female connector assembly 200. The teeth 312 will travel under the front portion 216 of the female connector assembly 200. When the teeth 312 travel beyond the front portion 216 of the female connector assembly 200, as shown in FIG. 6, and the first curved upper region 302 has not yet passed under the front portion 216, this can be referred to as the pre-lock position. In the pre-lock position, the first curved upper region 302 is directly contacting the rear edge 216B, and the teeth 312 are directly contacting the front edge 216A, as shown in FIG. 6.

Next, the male connector assembly 100 is connected to the female connector assembly 200, by inserting the female connector assembly 200 into the male connector opening 102 of the male connector assembly 100.

Last, the CPA device 300 is moved from the pre-lock position to the full-lock position as described herein. The first curved upper region 302 will travel under the front portion 216 of the locking component 204 of the female connector assembly 200. When the first curved upper region 302 travels beyond the front portion 216 of the locking component 204, as shown in FIG. 10, this is the full-lock position. In the full-lock position, the first curved upper region 302 is directly contacting the front edge 216A, and the latch 104 is at the rear edge 216B, as shown in FIG. 10.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

We claim:

1. A connector position assurance device, comprising:

a two-component locking system including an upper component and a lower component;

a pair of teeth formed at a front end of the lower component;

a first curved upper region formed on the upper component;

a back being connected to the upper component and the lower component; and a pair of arms being connected to the back, wherein the lower component has edges curved upward toward the upper component.

2. The connector position assurance device as in claim 1, wherein the first curved upper region is disposed between the pair of teeth and the back.

3. The connector position assurance device as in claim 1, wherein each of the arms has a flat exterior surface that does not have protrusions extending outward.

4. The connector position assurance device as in claim 1, wherein each of the arms has an interior surface facing toward the two-component locking system and an exterior surface facing outward, wherein the exterior surface does not have protrusions extending outward.

5. The connector position assurance device as in claim 1, wherein the teeth engage a locking component when the connector position assurance device is in a pre-lock position.

6. The connector position assurance device as in claim 1, wherein the first curved upper region engages a locking component when the connector position assurance device is in a full-lock position.

7. The connector position assurance device as in claim 1, wherein the upper component corresponds to a flexible beam.

8. The connector position assurance device as in claim 7, wherein the flexible beam flexes down toward the lower component when the first curved upper region is pushed down.

9. A method of operating a connector position assurance device, comprising the steps of:

providing a female connector assembly having a housing forming a female connector opening and a locking component;

accommodating a connector position assurance device in the female connector opening of the female connector assembly, wherein the connector position assurance device includes at least one arm and at least a two-component locking system having an upper component and a lower component, wherein the upper component includes at least a first curved upper region, the lower component includes at least a pair of teeth extending upward, and the at least one arm slides into the female connector opening;

providing a male connector assembly having a housing forming a male connector opening and at least one latch; and accommodating the female connector assembly into the male connector opening of the male connector assembly.

10. The method of operating a connector position assurance device as in claim 9, wherein the step of accommodating the connector position assurance device in the female connector opening of the female connector assembly further comprises a step of engaging the pair of teeth with the locking component of the female connector assembly, corresponding to a pre-lock position.

11. The method of operating a connector position assurance device as in claim 10, further comprising a step of engaging the first curved upper region with the locking component of the female connector assembly, corresponding to a full-lock position.

12. The method of operating a connector position assurance device as in claim 11, wherein the step of accommodating the female connector assembly into the male connector opening of the male connector assembly further comprises a step of engaging the at least one latch of the male connector assembly with the locking component of the female connector assembly.

13. A connector position assurance device, comprising:

an upper component forming at least a first curved upper region;

a lower component forming an aperture below the first curved upper region, and forming a pair of teeth at a front end of the lower component; and a back being connected to the upper component and the lower component, wherein the lower component has edges curved upward toward the upper component, wherein the first curved upper region is disposed between the pair of teeth and the back.

14. The connector position assurance device as in claim 13, wherein the connector position assurance device is accommodated into a female connector opening of a female connector assembly having a locking component, and the pair of teeth engage the locking component in a pre-lock position.

15. The connector position assurance device as in claim 14, wherein the upper component forms a second curved upper region that connects the upper component to the back.

16. The connector position assurance device as in claim 14, wherein the first curved upper region flexes down toward the aperture when the first curved upper region is pushed by the locking component of the female connector assembly.

17. The connector position assurance device as in claim 14, further comprising a pair of arms being connected to the back.

18. The connector position assurance device as in claim 14, wherein the female connector assembly is accommodated into a male connector opening of a male connector assembly having at least one latch.

19. The connector position assurance device as in claim 18, wherein the first curved upper region engages the locking component in a full-lock position to securely hold the male connector assembly to the female connector assembly.

20. The connector position assurance device as in claim 18, wherein the at least one latch engages the locking component, and the first curved upper region engages the locking component, in a full-lock position, to securely hold the male connector assembly to the female connector assembly.

* * * * *